US007096763B1

(12) United States Patent
Hsieh

(10) Patent No.: US 7,096,763 B1
(45) Date of Patent: Aug. 29, 2006

(54) DIRECTION CONTROL DEVICE OF RATCHET SPANNER

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/060,686

(22) Filed: Feb. 18, 2005

(51) Int. Cl.
*B25B 13/46* (2006.01)

(52) U.S. Cl. ..... 81/63.2; 81/60; 81/61; 81/62; 81/63; 81/63.1

(58) Field of Classification Search ..... 81/60–63.2
See application file for complete search history.

(56) References Cited

U.S. PATENT DOCUMENTS 6,382,052 B1 * 5/2002 Chen ..... 81/63
6,453,779 B1 * 9/2002 Hu ..... 81/63
6,609,444 B1 * 8/2003 Hsien ..... 81/63.2

* cited by examiner

*Primary Examiner*—Joseph J. Hail, III
*Assistant Examiner*—Bryan Muller

(57) ABSTRACT

The direction control device comprises a spanner body having a receiving chamber at a head portion thereof; a lateral side of the receiving chamber formed with a braking groove; the spanner body having a direction control groove communicated to the braking groove; a ratchet wheel being received in the receiving chamber and a brake block being received in the braking groove; the brake block being engaged to the ratchet wheel; a direction control unit received in the direction control groove; the direction control unit including a direction control block, a control sheet, and an elastic ejecting device; one end of the direction control block being formed with a control portion; and an upper end of the brake block capable of engaging with a ratchet wheel; a lower end of the brake block having an inserting hole and the brake block being formed with a notch near the inserting hole.

1 Claim, 5 Drawing Sheets

DIRECTION CONTROL DEVICE OF RATCHET SPANNER

FIELD OF THE INVENTION

The present invention relates to a ratchet spanner, and particularly to a direction control device of a ratchet spanner, in that ratchet wheel of the spanner can be operated steadily so as to have a lower destroying possibility.

BACKGROUND OF THE INVENTION

Ratchet spanners must have efficient direction control devices to control the operation directions of the ratchet wheel efficiently.

In U.S. Pat. No. 6,609,444, a direction control device of a ratchet spanner is disclosed. The direction control device includes a spanner body, a ratchet wheel, a brake block and a direction control unit. A head portion of the spanner body is installed with a receiving chamber. A lateral side of the receiving chamber has a braking groove and a direction control groove. The direction control groove is communicated to the braking groove. The receiving chamber serves to receive the ratchet wheel and the braking groove serves to receiver a brake block which is engaged to the ratchet wheel. The direction control unit includes a direction control block and an elastic ejecting device. The direction control block receives the elastic ejecting device. A T shape stopper is installed on the direction control block for preventing the elastic ejecting device to fall out as switching the resisting position of the brake block.

In this prior art direction control device of a ratchet spanner, the elastic ejecting device is used to change the resisting position of the brake block. The elastic ejecting device is formed mainly by a spring. Therefore, the T shape stopper on the direction control block can confine the elastic ejecting device from falling. However when the resisting direction of the brake block is switched by the direction control block, the spring of the elastic ejecting device will suffer from a greater transversal force. Since the spring cannot absorb the transversal force, it is possible that the spring will deform. Thus, the direction control device of a ratchet spanner will be destroyed. Furthermore, only one end of the T shaper stopper resists against the direction control block. It is possibly that the T shape stopper will fall out and thus it is impossible for preventing the elastic ejecting device from falling out. In summary, the prior art is not practical and thus it is necessary to be improved.

SUMMARY OF THE INVENTION

Accordingly, the primary object of the present invention is to provide a direction control device of a ratchet spanner, in that the ratchet wheel of the spanner can be operated steadily so as to have a lower destroying possibility.

To achieve the above objects, the present invention provides a direction control device of a ratchet spanner. The direction control device comprises a spanner body having a receiving chamber at a head portion thereof; a lateral side of the receiving chamber formed with a braking groove; the spanner body having a direction control groove which is communicated to the braking groove; a ratchet wheel being received in the receiving chamber and a brake block being received in the braking groove; the brake block being engaged to the ratchet wheel; a direction control unit received in the direction control groove; the direction control unit including a direction control block, a control sheet, and an elastic ejecting device; one end of the direction control block being formed with a control portion; and an upper end of the brake block capable of engaging with a ratchet wheel; a lower end of the brake block having an inserting hole for receiving the spring of the elastic ejecting device so that the elastic ejecting device provides an elastic force to resist against the receiving chamber; the brake block being formed with a notch near the inserting hole; a width of the notch being slightly larger than a width of a front end of the control sheet for receiving the front end of the control sheet in the notch of the brake block.

The various objects and advantages of the present invention will be more readily understood from the following detailed description when read in conjunction with the appended drawing.

DETAILED DESCRIPTION OF THE INVENTION

Figure 1:
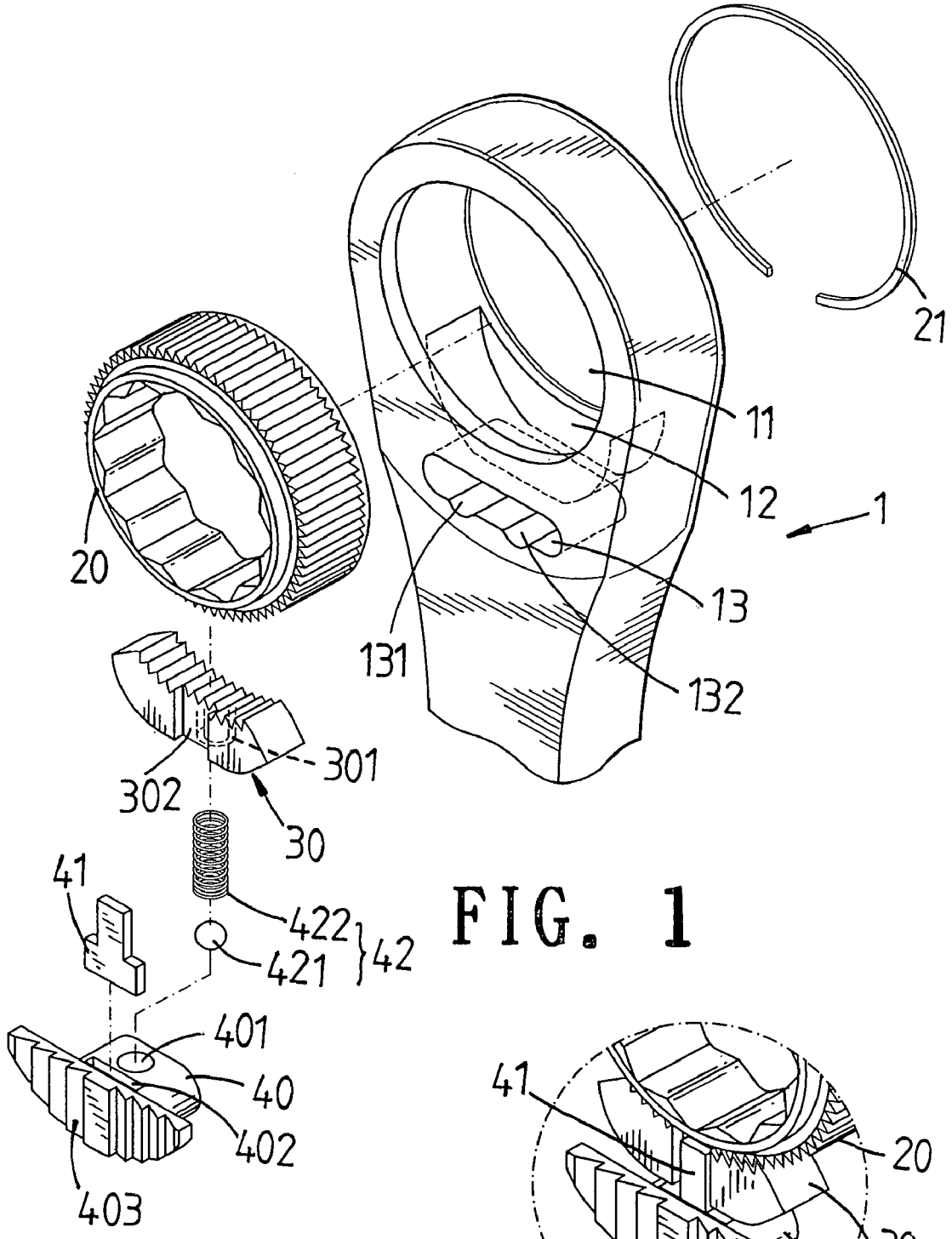
FIG. 1 is an exploded perspective view of the direction control device of a ratchet spanner of the present invention.
Figure 2:
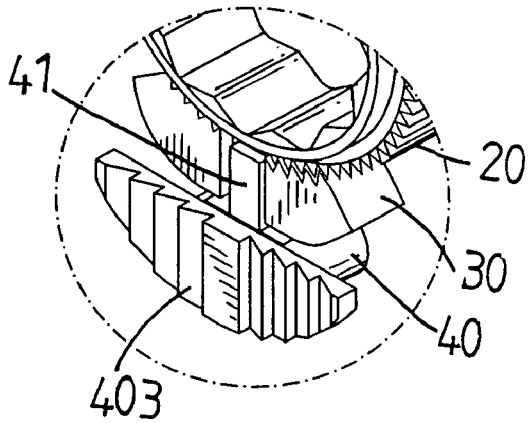
FIG. 2 is a partial enlarged perspective view of the direction control device of a ratchet spanner of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 4, the direction control device of a ratchet spanner of the present invention is illustrated. The direction control device of a ratchet spanner has the following elements.

A spanner body 1 has a receiving chamber 11 at a head portion thereof. A lateral side of the receiving chamber 11 is formed with a braking groove 12. The spanner body 1 also has a direction control groove 13 which is communicated to the braking groove 12. A ratchet wheel 20 is received in the receiving chamber 11 and a brake block 30 is received in the braking groove 12. The brake block 30 is engaged to the ratchet wheel 20. A lower side of the direction control groove 13 has a left slot 131 and a right slot 132.

A direction control unit is received in the direction control groove 13. The direction control unit includes a direction control block 40, a control sheet 41, and an elastic ejecting device 42. The elastic ejecting device 42 includes a steel ball 421 and a spring 422. The direction control block 40 is installed with a receiving hole 401 for receiving the elastic ejecting device 42. The steel hall 421 of the elastic ejecting device 42 is resisted in one of the left slot 131 and the right slot 132 so as to have the effect of positioning. The direction control block 40 has a positioning groove 402 near the receiving hole 401 for receiving the control sheet 41 so as to prevent the elastic ejecting device 42 from sliding out in switching operation. One end of the direction control block 40 is formed with a control portion 403. The user can press the control portion 403 for switching.

An upper end of the brake block 30 is capable of engaging with a ratchet wheel 20. A lower end of the brake block 30 has an inserting hole 301 for receiving the spring 422 of the elastic ejecting device 42 so that the elastic ejecting device 42 provides an elastic force to resist against the receiving chamber 11. The brake block 30 is formed with a notch 302 near the inserting hole 301. A width of the notch 302 is slightly larger than a width of a front end of the control sheet 41 for receiving the front end of the control sheet 41 in the notch 302 of the brake block 30.

In assembly of the present invention, the direction control block 40 is firstly received into the direction control groove 13 from the end of the direction control block 40 having the receiving hole 401 and the positioning groove 402. Then the control sheet 41 is inserted into the positioning groove 402 of the direction control block 40 from the braking groove 12 (referring to FIG. 2). One end of the elastic ejecting device 42 having the steel ball 421 is placed into the receiving hole 401 of the direction control block 40 from the braking groove 12. Then the brake block 30 is placed into the braking groove 12. Then the control sheet 41 is placed in the notch 302 and another end of the elastic ejecting device 42 is placed into the inserting hole 301. Then the ratchet wheel 20 is placed into the receiving chamber 11 at the head portion of the spanner body 1. A C ring serves to confine the ratchet wheel 20 in the receiving chamber 11 of the ratchet wheel 20 so that the ratchet wheel 20 is rotatably engaged to the brake block 30. Therefore, the assembly of the direction control device of a ratchet spanner of the present invention is complete. The control sheet 41 is inserted into the positioning groove 402 of the direction control block 40 for preventing the spring 422 of the elastic ejecting device 42 to eject out so as to reduce the error probability. One end of the control sheet 41 is received in the notch of the brake block 30. When the position of the direction control block 40 is switched, the control sheet 41 will drive the brake block 30 to move.

Figure 3:
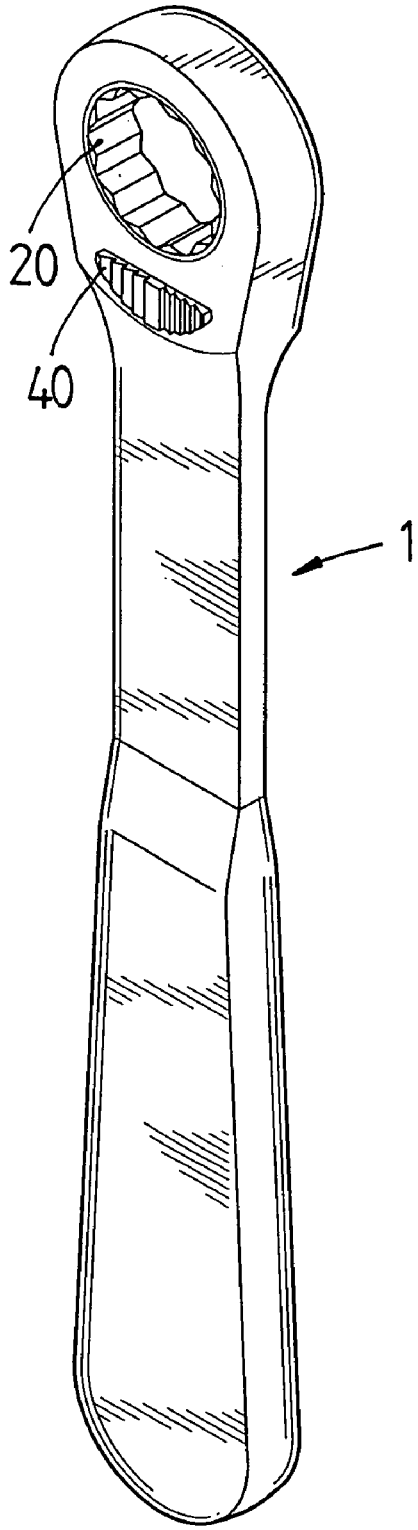
FIG. 3 is an assembled perspective view of the direction control device of a ratchet spanner of the present invention.
Figure 4:
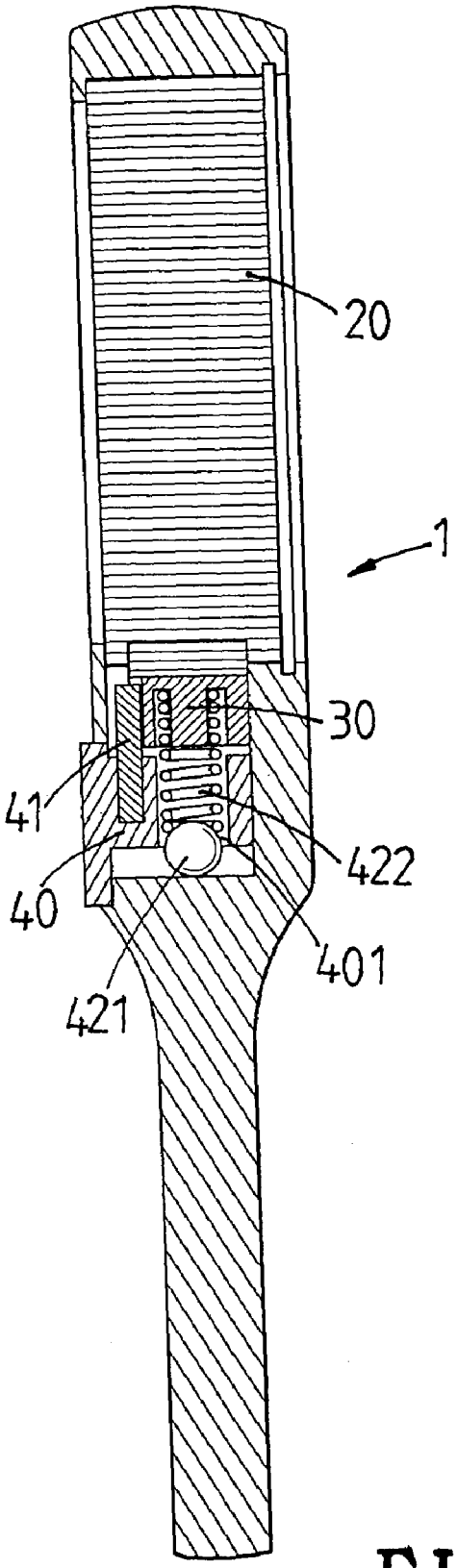
FIG. 4 is a lateral cross sectional view about the direction control device of a ratchet spanner of the present invention.
Figure 5:
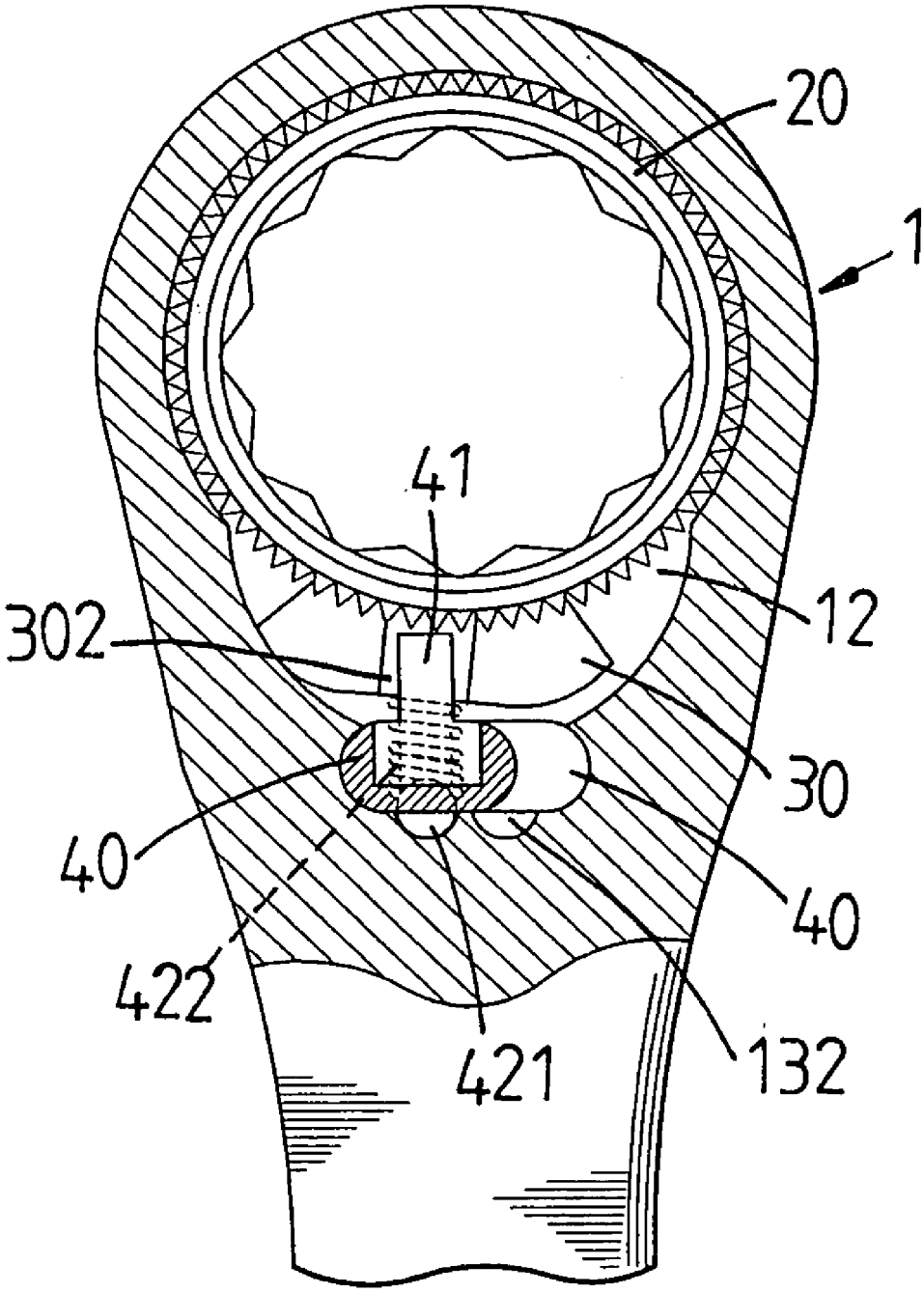
FIGS. 5 and 6 are cross sectional views showing the operation of the direction control device of a ratchet spanner of the present invention.
Figure 6:
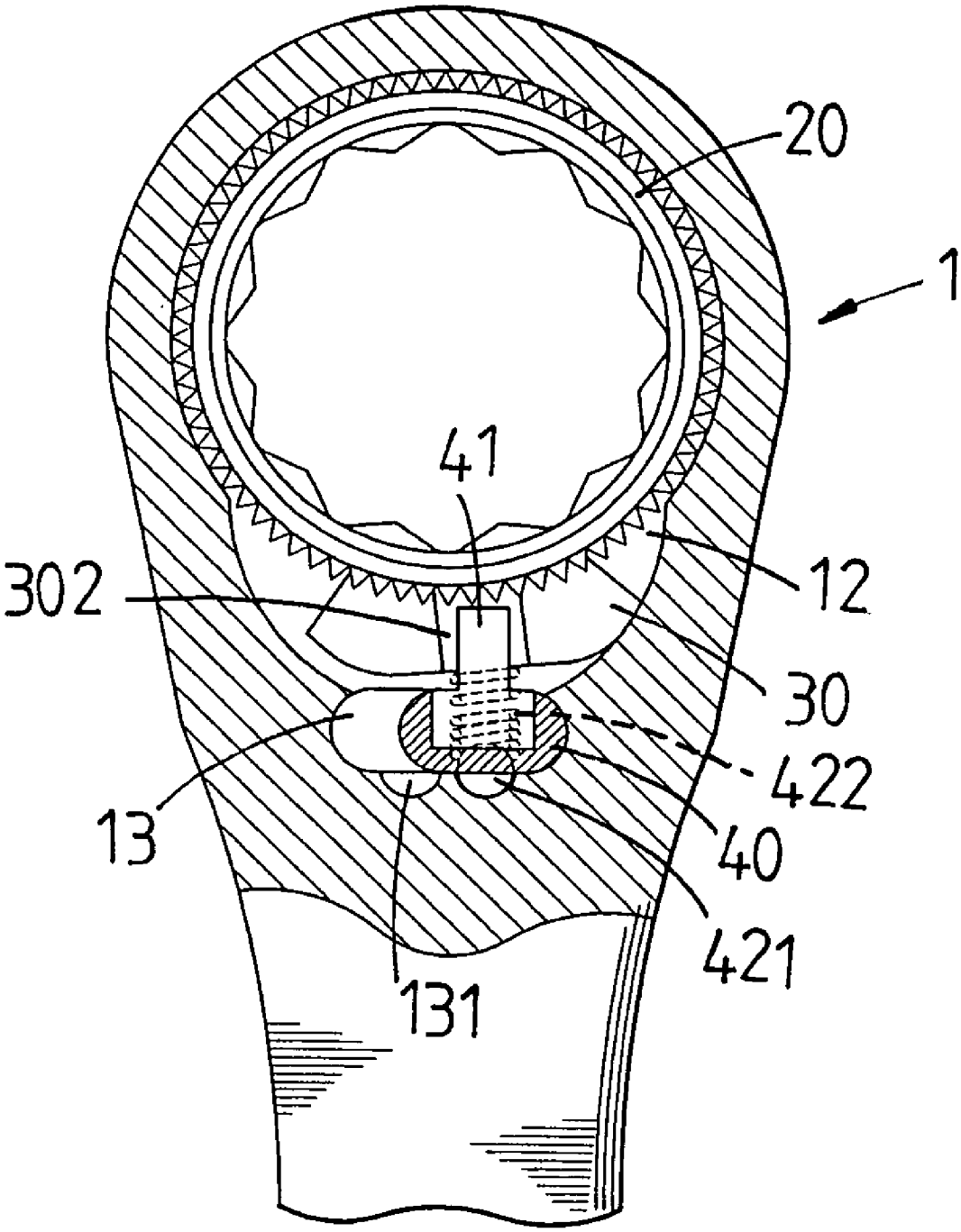

Referring to FIGS. 3, 5 and 6, when the direction control block 40 is at a right side of the direction control groove 13, the steel ball 421 of the elastic ejecting device 42 will fill into the left slot 131 of the direction control groove 13 so that the direction control block 40 will not slide easily. Then, the direction control block 40 is ejected by the spring 422 of the elastic ejecting device 42 to engage the left lower side of the ratchet wheel 20. When a force is applied to the ratchet wheel 20, the ratchet wheel 20 rotates clockwise, since the lift end of the brake block 30 engaged to the ratchet wheel 20 is engaged to the inner wall of the braking groove 12, it has no space for retracting and the ratchet wheel 20 cannot rotate clockwise. Thereby the screw means can be driven clockwise. Furthermore, when a force is applied to the ratchet wheel 20 to rotate counterclockwise, since the right end of the brake block 30 has no obstacle, if the rotating force of the ratchet wheel 20 is greater than that of the spring 422, the brake block 30 will retract and since the notch of the brake block 30 is slightly larger than the control sheet 41, when the brake block 30 retracts leftwards, it is not hindered by the control sheet 41. Thus the ratchet wheel 20 can rotate counterclockwise. When it is desired to change the driving direction, the control portion of the direction control block 40 serves to complete the work. When a force is applied to drive the control portion to move rightwards, the direction control block 40 will move rightwards, one end of the control sheet 41 of the direction control block 40 is received into the notch of the brake block 30. Thus, the control sheet 41 can drive the brake block 30 to move rightwards, it will not be interfered by the control sheet 41 so that the ratchet wheel 20 rotates counterclockwise. If it is desired to switch the driving direction, the control portion of the direction control block 40 can be used. When the user applies a force to drive the control portion to move rightwards, the direction control block 40 will move rightwards. When the direction control block 40 moves to the right side of the direction control groove 13. One end of the control sheet 41 of the direction control block 40 is received in the notch of the brake block 30. Thereby the control sheet 41 may drive the brake block 30 to move rightwards. When direction control block 40 moves to the right side of the direction control groove 113, the steel hall 421 of the elastic ejecting device 42 will move into the right slot 132. The spring 422 will eject the brake block 30. As above mentioned, the ratchet wheel 20 cannot rotate counterclockwise. Thus, the screwing means can be driven counterclockwise. Thus, it is known that the direction control device of a ratchet spanner of the present invention not only has the function of preventing the elastic ejecting device 42 from ejecting out by using the control sheet 41, but also the brake block 30 can be driven. Thereby the spring 422 of the elastic ejecting device 42 will not deform by a transversal stress when the spring 422 drive the brake block 30. Thus the lifetime is prolonged.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A ratchet spanner having a direction control device; comprising:

a spanner body having a receiving chamber at a head portion thereof; a ratchet wheel being received in the receiving chamber;

a braking groove at a lateral side of the receiving chamber;

a direction control groove in the spanner body and communicated to the braking groove; and a lower side of the direction control groove having a left slot and a right slot;

a direction control unit received in the direction control groove; the direction control unit including a direction control block, a control sheet, the control sheet having a "T" shape with a transversal bar and a longitudinal bar extended from a middle portion of the transversal bar; an elastic ejecting device; one end of the direction control block being formed with a control portion; and the elastic ejecting device including a steel ball and a spring; the steel ball of the elastic ejecting device being resisted in one of the left slot and the right slot so as to have the effect of positioning; the direction control block being formed with a receiving hole for receiving the elastic ejecting device; the direction control block having a positioning groove near the receiving hole for receiving the control sheet to prevent the elastic ejecting device and the direction control block from sliding out of the spanner body during switching operation; the direction control block having a control portion which is formed as an approximately triangular shape; a plurality of parallel teeth being formed an outer surface of the control portion; and a brake block being received in the braking groove; the brake block being engaged to the ratchet wheel; an upper end of the brake block capable of engaging with the ratchet wheel; a lower side of the brake block having an inserting hole for receiving the spring of the elastic ejecting device so that the elastic ejecting device provides an elastic force to resist against the receiving chamber; the brake block being formed with a notch near the inserting hole; a width of the notch being slightly larger than a width of the longitudinal bar of the control sheet; and the longitudinal bar of the control sheet is received in the notch of the brake block.

* * * * *